US007100762B2

(12) United States Patent
Marco

(10) Patent No.: US 7,100,762 B2
(45) Date of Patent: Sep. 5, 2006

(54) THREE PACK CONTAINER CARRIER

(75) Inventor: Leslie S. Marco, Bloomingdale, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/872,686

(22) Filed: Jun. 21, 2004

(65) Prior Publication Data

US 2005/0279650 A1 Dec. 22, 2005

(51) Int. Cl.
*B65D 75/00* (2006.01)
*B66C 1/10* (2006.01)

(52) U.S. Cl. ..... 206/150; 206/151; 206/161; 294/87.2

(58) Field of Classification Search ..... 206/150, 206/161, 147, 151, 158, 162, 192, 197, 427
See application file for complete search history.

(56) References Cited

U.S. PATENT DOCUMENTS 3,300,041 A * 1/1967 Fuller ..... 206/161
4,149,631 A * 4/1979 Cunningham ..... 206/150
4,557,375 A * 12/1985 Weaver et al. ..... 206/241
D291,657 S * 9/1987 Carr et al. ..... D9/752
4,752,001 A * 6/1988 Olsen ..... 206/150
4,782,955 A 11/1988 Weaver et al.
5,269,406 A 12/1993 Olsen et al.
5,511,656 A * 4/1996 Olsen ..... 206/150
6,032,791 A 3/2000 Gresh, Jr. et al.
6,056,115 A * 5/2000 Olsen ..... 206/150
6,122,893 A 9/2000 Weaver et al.
6,125,999 A 10/2000 Slomski
6,170,225 B1 1/2001 Cervantes et al.

* cited by examiner

*Primary Examiner*—Jila M Mohandesi
(74) *Attorney, Agent, or Firm*—Pauley Petersen & Erickson

(57) ABSTRACT

This invention relates to a carrier and method of packaging containers into a unitized package that includes a generally continuous plastic sheet having a plurality of container apertures extending longitudinally in adjacent pairs. A container is positioned within each container aperture and the plastic sheet is separated along central lines of weakness and peripheral lines of weakness, resulting in multiple unitized packages of exactly three containers arranged in a generally triangular configuration.

18 Claims, 3 Drawing Sheets

THREE PACK CONTAINER CARRIER

BACKGROUND OF THE INVENTION

1. Field of the Invention

This invention relates to a carrier for unitizing three containers.

2. Description of Prior Art

Conventional container carriers are often used to unitize a plurality of similarly sized containers, such as cans, bottles and/or similar containers that require unitization. Plastic ring carriers having a plurality of container apertures are one such conventional container carrier.

SUMMARY OF THE INVENTION

A carrier according to this invention carries a plurality of containers such as cans. Raw carrier stock for forming individual carriers preferably comprises a planar, plastic sheet formed with a plurality of container apertures, arranged longitudinally in adjacent pairs. The carrier stock inherently includes a first longitudinal edge and an opposite, second longitudinal edge defining outer edges of the plastic sheet.

At each of alternating adjacent pairs of container apertures, a central line of weakness is positioned in the plastic sheet between container apertures in an adjacent pair. In addition, a first peripheral line of weakness is positioned near the first longitudinal edge and between one container aperture of a pair of container apertures and a container aperture immediately to one side. Likewise, a second peripheral line of weakness is positioned near the second longitudinal edge and between an other container aperture of the pair of container apertures and a container aperture immediately to the opposite side. As a result, the peripheral lines of weakness alternate between adjacent pairs of container apertures along the carrier stock, specifically alternating between a position near the first longitudinal edge and a position near the second longitudinal edge.

In practice, each carrier is preferably separated from a generally continuous carrier stock. Specifically, however, each carrier for unitizing three containers is preferably formed in connecting pairs of "base carriers" having six container apertures arranged in three connecting and adjacent pairs of container apertures. The central line of weakness is formed between container apertures in a center adjacent pair of the container apertures. In addition, the two peripheral lines of weakness are formed in each base carrier so that one peripheral line of weakness is formed on each side of the center adjacent pair from near opposite outer edges of the base carrier. As a result of this arrangement, the base carrier is divisible along the central line of weakness and the two peripheral lines of weakness to form two carriers each for unitizing three containers.

A method of packaging containers using the described carrier, or carrier stock, preferably first includes positioning a container into each container aperture. Next, each central line of weakness is separated in the plastic sheet and each peripheral line of weakness is additionally separated so as to form a plurality of individual carriers of exactly three containers arranged in a generally triangular package.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
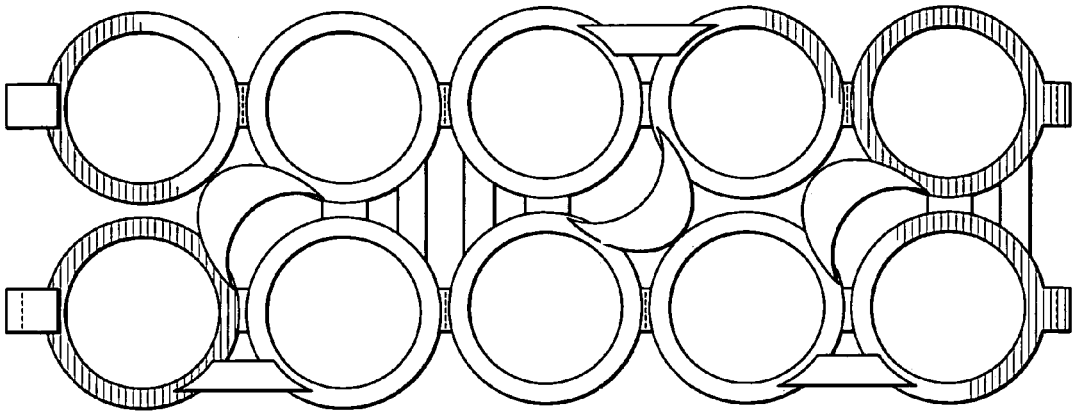
FIG.1 (PRIOR ART)
FIG. 1 is a top view of existing embodiment of a carrier divisible into three packs.

FIG. 1 shows a concept for creating a three pack carrier from a plurality of container apertures.

Figure 5:
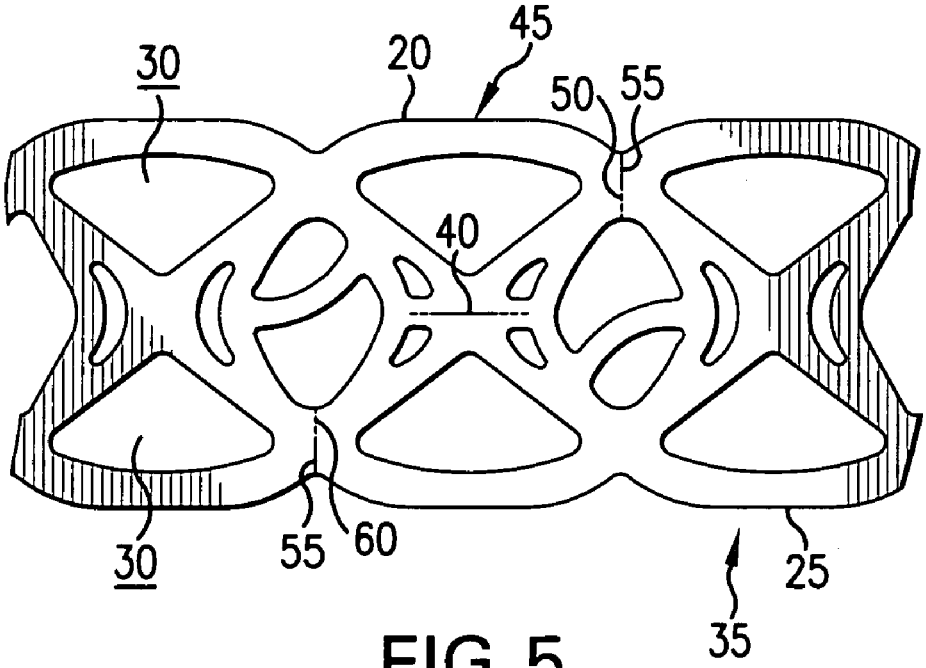
FIG. 5 is a top view of the base carrier shown in FIG. 4 following slitting but prior to separation.
Figure 6:
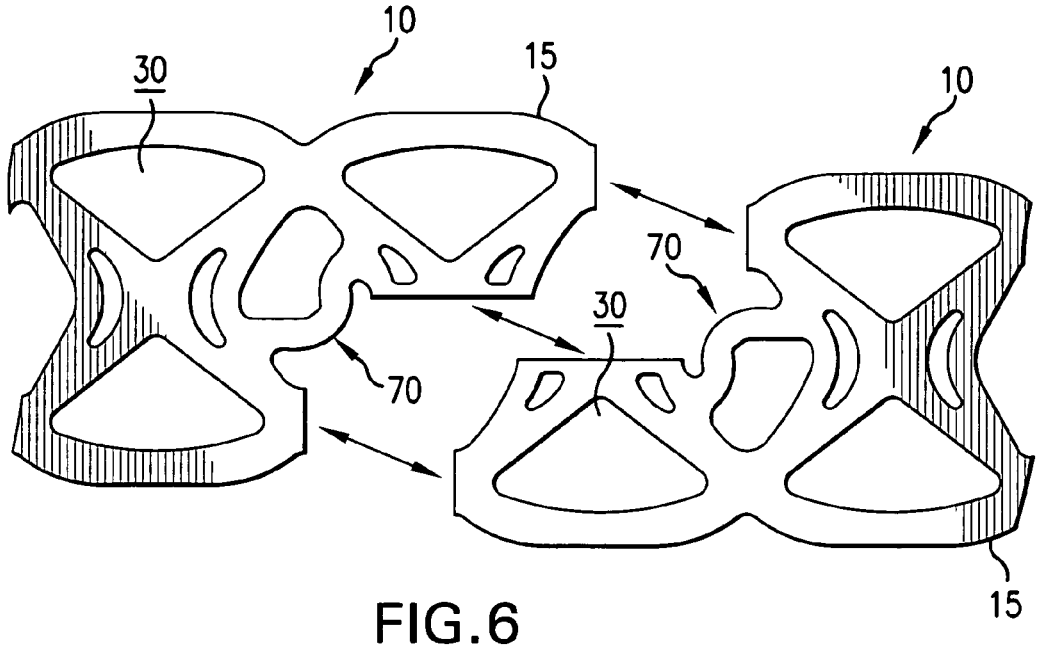
FIG. 6 is a top view of a base carrier following separation into two individual carriers.
Figure 7:
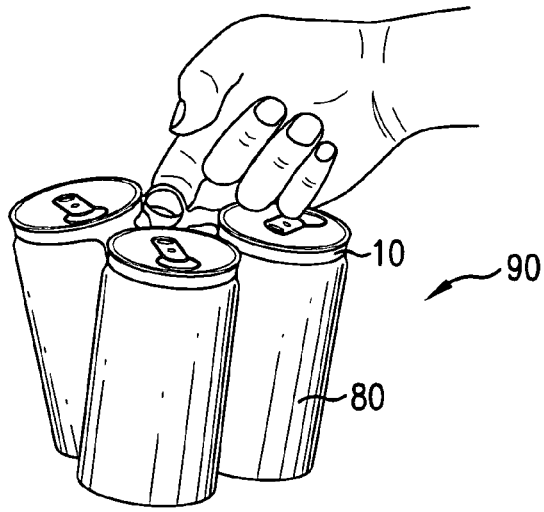
FIG. 7 is a side view of a package of three containers according to one preferred embodiment of this invention.
Figure 8:
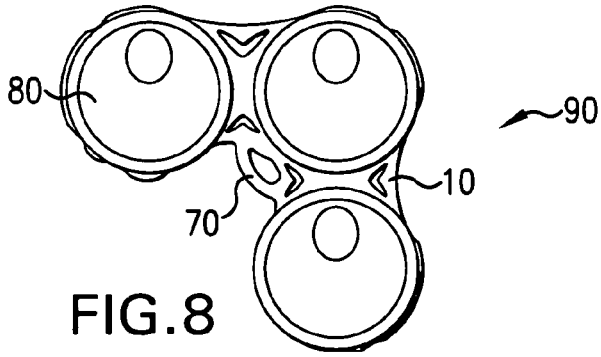
FIG. 8 is a top view of a package of three containers according to one preferred embodiment of this invention.

FIGS. 2–8 show carrier 10 for carrying a plurality of containers 80, according to various preferred embodiments of this invention. Containers 80, such as those shown in packages 90 in FIGS. 7 and 8, are preferably cans. Although cans are shown in FIGS. 7 and 8, bottles or any other commonly unitized container 80 may be used with carrier 10 according to this invention. Containers 80 are preferably like-sized within a single carrier 10.

Carrier 10 unitizes a plurality of containers 80 to create package 90, such as package 90 shown in FIGS. 7 and 8. Carrier 10 comprises plastic sheet 15 preferably constructed from a flexible, resilient material such as, in one preferable embodiment, low density polyethylene.

Plastic sheet 15 of material is preferably cut, using means known to those skilled in the art, such as a stamping die, to form a plurality of container apertures 30 in plastic sheet 15. Container apertures 30 are preferably formed in a desired shape to sufficiently engage and retain a respective container 80. Such shapes may include generally triangular, round and/or a rectangular shape, each preferably having generally radiused or rounded corners. Plastic sheet 15 may include other configurations of container apertures 30 depending on the size of package 90 and/or containers 80 desired. As shown in FIG. 6, each discrete carrier 10 preferably comprises three container apertures 30 arranged in a generally triangular configuration.

As partially shown in FIG. 2, carrier 10 is preferably manufactured so that raw carrier stock includes a generally continuous roll of plastic sheet 15 having a plurality of adjacent carriers 10 that are punched and then wound onto a spool (not shown) having several thousand carriers 10, each carrier 10 attached to each adjacent carrier 10, as described in more detail below. Carriers 10 are later applied to containers 80 to form packages 90 and, during such process, are preferably unwound from spools and then separated from each other to form individual packages 90.

As described, carrier stock preferably includes a planar, generally continuous plastic sheet 15 having first longitudinal edge 20 and second longitudinal edge 25 defining outer edges thereof. A plurality of container apertures 30 extend between the outer edges of plastic sheet 15 longitudinally through plastic sheet 15 in adjacent pairs 35.

At each of alternating adjacent pairs 35 of container apertures, central line of weakness 40 is positioned in plastic sheet 15 between container apertures 30 in an adjacent pair 35. Central line of weakness 40 preferably extends longitudinally between alternating adjacent pairs 35 of container apertures 30 thereby preferably bisecting carrier stock between every other adjacent pair 35 of container apertures 30.

Figure 2:
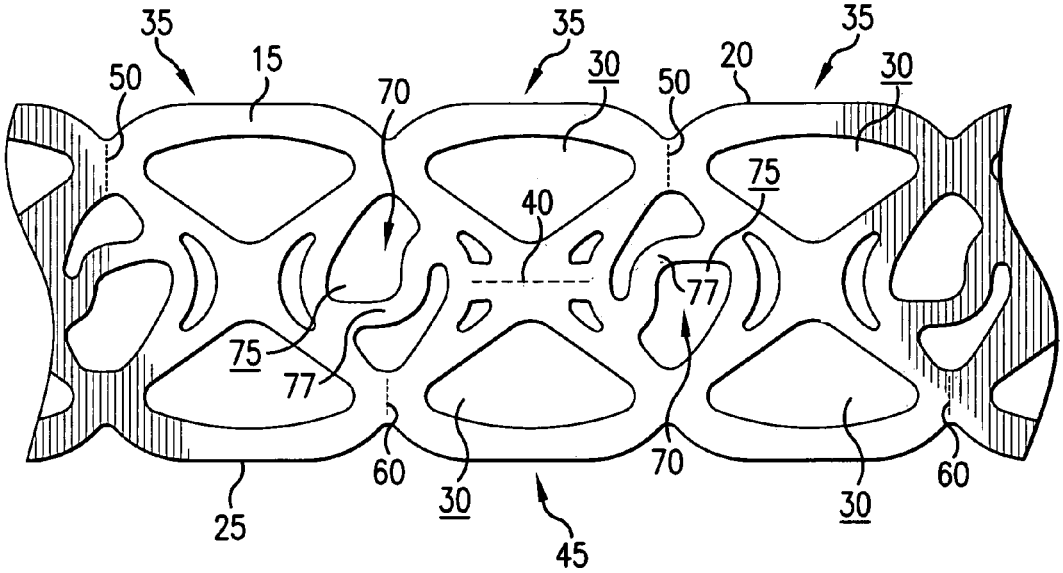
FIG. 2 is a top view of carrier stock according to one preferred embodiment of this invention.
Figure 3:
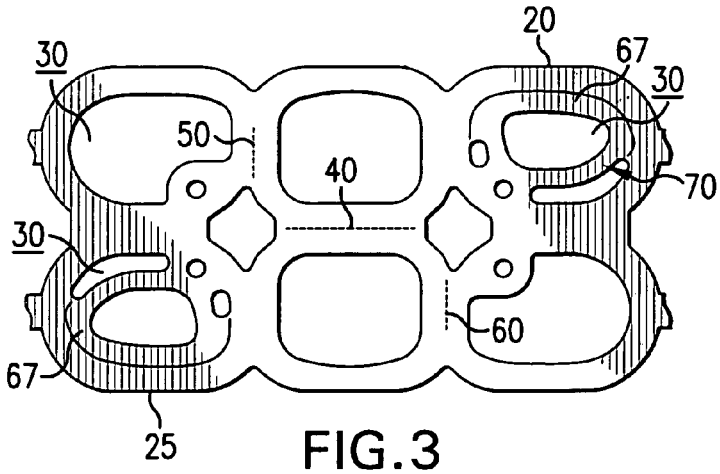
FIG. 3 is a top view of a base carrier according to one preferred embodiment of this invention.
Figure 4:
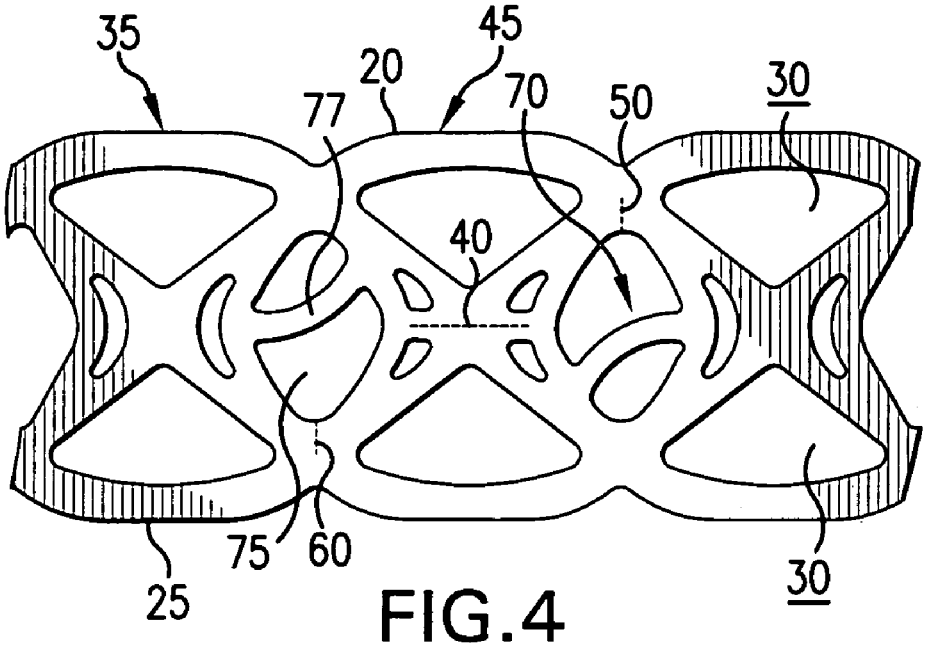
FIG. 4 is a top view of a base carrier prior to slitting and separation according to one preferred embodiment of this invention.

As best shown in FIGS. 2–4, first peripheral line of weakness 50 is positioned near first longitudinal edge 20 and between one container aperture 30 of a pair of container apertures and a container aperture immediately to one side. In addition, second peripheral line of weakness 60 is positioned near second longitudinal edge 25 and between the other container aperture of the pair of container apertures 35 and a container aperture immediately to the other side, opposite the one side. As such, peripheral lines of weakness 50, 60 alternate between adjacent pairs 35 of container apertures 30 along the carrier stock, specifically alternating between a position near first longitudinal edge 20 and a position near second longitudinal edge 25.

Lines of weakness 40, 50 and 60 may comprise perforations, serrations, slits, reduced thickness or combination thereof formed in plastic sheet 15 and are preferably tearable or frangible to permit separation of plastic sheet 15 along a defined line. In addition, lines of weakness 40, 50 and 60 preferably do not extend directly into any edge or aperture of plastic sheet 15 but instead are preferably positioned within interior portions of plastic sheet 15.

According to one preferred embodiment of this invention, handle 70 is positioned between adjacent pairs 35 of container apertures 30. Handle 70 is additionally positioned within carrier 10 to provide an ample area for a purchaser to grab by inserting his hand or fingers through and still maintain the integrity of carrier 10.

Handle 70 may comprise finger aperture 75 positioned between adjacent pairs 35 of container apertures 30 and strap 77 extending through finger aperture 75. As shown in FIGS. 2, 4 and 5, strap 77 is preferably aligned toward one end of the finger aperture 75.

As shown in FIGS. 2, 4 and 5, each handle 70 is preferably positioned in a different alignment from each adjacent handle 70. More specifically, a finger aperture 75 is positioned between adjacent pairs 35 of container apertures 30 and strap 77 extends asymmetrically relative to an imaginary longitudinal axis and transverse axis of finger aperture 75.

In an arrangement of carrier 10 having handle 70, such as shown in FIG. 2, central line of weakness 40 preferably comprises a perforation or similar arrangement of slits or similar weakness in plastic sheet 15 that extends between, but not into, each adjacent handle 70, or more specifically, each adjacent finger aperture 75.

In the arrangement of carrier 10 having handle 70, such as shown in FIGS. 2, 4 and 5, first peripheral line of weakness 50 preferably extends between finger aperture 75 of handle 70 and an interior portion of plastic sheet 15 near, but not up to, first longitudinal edge 20. Alternatively, first peripheral line of weakness 50 may extend up to and into first longitudinal edge 20 of plastic sheet 15. However, such arrangement where first peripheral line of weakness 50 extends into first longitudinal edge 20 may result in tearing of carrier 10 during application to containers 80. Likewise, second peripheral line of weakness 60 preferably extends between an opposite finger aperture 75 of handle 60 and near, but not up to, second longitudinal edge 25 of plastic sheet 15.

FIG. 3 shows one preferred embodiment of the invention having finger loop 67 positioned within every third container aperture 30 along first longitudinal edge 20 and every third aperture 30 along second longitudinal edge 25 so that every first and third adjacent pair 35 of container apertures 30 include an internally positioned finger loop 67 along opposite outer edges of plastic sheet 15. As such, every second adjacent pair 35 of container apertures 30 is free from finger loop 67.

As a result of the configuration shown in FIG. 3 and described above, when containers 80 are inserted into container apertures 30 of this embodiment, finger loop 67 is partially expelled from its respective container aperture 30 and, following division of carriers 10, as further described below, a resultant package is portable using finger loop 67.

In practice, each carrier 10 is preferably separated from a generally continuous carrier stock, as described. More specifically, however, each carrier 10 for unitizing three containers 80 is preferably formed in connecting pairs of "base carriers" having six container apertures 30 arranged in three connecting and adjacent pairs 35 of container apertures 30. As described above, central line of weakness 50 is formed between container apertures 30 in a center adjacent pair 45 of container apertures 30. In addition, two peripheral lines of weakness 50, 60 are formed in each base carrier. One peripheral line of weakness 50, 60 is preferably formed on each side of the center adjacent pair 45 from near opposite outer edges 20, 25 of the base carrier. As a result of this arrangement, the base carrier is divisible along central line of weakness 40 and two peripheral lines of weakness 50, 60 to form two carriers 10 each for unitizing three containers 80, as shown in FIG. 6.

FIGS. 4 and 5 partially illustrate a method of packaging containers 80 that includes providing a generally continuous plastic sheet 15 having a plurality of container apertures 30 extending longitudinally in adjacent pairs 35, as described herein. Preferably, though not shown in FIG. 5, containers 80 are positioned in each container aperture 30 using a conventional packaging machine known to those having ordinary skill in the art.

Weaver et al., U.S. Pat. No. 6,122,893, and Cervantes et al., U.S. Pat. No. 6,170,225, each describe various features of a packaging machine suitable for use with the subject invention and such references are hereby incorporated by reference. Preferably, the packaging machine, also called an applicating machine, includes a drum having a plurality of jaw pairs that engage each adjacent pair 35 of container apertures 30 and transversely stretch plastic sheet 15 so as to engage each container aperture 30 with each container 80, specifically about a chime of such container 80. Such applicating machines require a generally continuous plastic sheet having an array of interconnected rings forming container apertures 30 so that each container aperture 30 is connected to each other adjacent container aperture 30 both longitudinally and in the transverse direction. Immediately following application of continuous plastic sheet 15 to containers 80, each container 80 is separately positioned within a respective container aperture 30 arranged in a generally continuous array of longitudinally extending and connecting adjacent pairs 35 of container apertures 30 and containers 80.

The stretching engagement of carrier 10 with containers 80, creates a stressed condition in central line of weakness 40 and peripheral lines of weakness 50, 60. Each central line of weakness 40 may then be separated in plastic sheet 15, preferably using a mechanical device such as a blade, a knife, a wedge or similar device, as carrier 10 travels through a packaging line. Generally contemporaneously with separation of central line of weakness 40, a nick or cut 55 is placed into a respective longitudinal edge 20, 25 of plastic sheet 15 directly adjacent, and preferably into, each peripheral line of weakness 50, 60.

Depending upon the desired final processing of individual packages 90, such as palletization, central line of weakness 40 may be separated in a distinct step from separation of peripheral lines of weakness 50, 60. For instance, central line of weakness 40 may be initially separated, followed by a turning and diverting operation, followed by separation of peripheral lines of weakness 50, 60.

As a result of the stressed condition of the respective lines of weakness 40, 50 and 60, a knife or similar device creates a clean separation and break of plastic sheet 15 thereby forming discrete individual carriers 30. More specifically, the base carrier is separated along central line of weakness 40 and peripheral lines of weakness 50, 60 so as to form two individual carriers 10 of exactly three containers 80 arranged in a generally triangular package 90, such as shown in FIGS. 7 and 8.

The resulting package 90 of three containers 80 may then be lifted and carried using handle 70 positioned within an "elbow" or corner of package 90. A consumer may then remove containers 80 as desired and appropriately dispose of the empty carrier 30.

While in the foregoing specification this invention has been described in relation to certain preferred embodiments thereof, and many details have been set forth for purpose of illustration, it will be apparent to those skilled in the art that carrier 10 and the related method of manufacture are susceptible to additional embodiments and that certain of the details described herein can be varied considerably without departing from the basic principles of the invention.

The invention claimed is:

1. A carrier for unitizing three containers into a package comprising:

a base carrier having six container apertures arranged in three connecting and adjacent pairs of container apertures;

a central line of weakness formed between container apertures exclusively in the center pair of container apertures; and two peripheral lines of weakness, one peripheral line of weakness formed on each side of the center adjacent pair of container apertures from near opposite outer edges of the base carrier, the base carrier divisible along the central line of weakness and the two peripheral lines of weakness to form two carriers each for unitizing three containers, each of the two carriers free of additional severable lines of weakness.

2. The carrier of claim 1 further comprising:

a handle formed between each adjacent pair of container apertures, the handle including a strap extending through a finger aperture.

3. The carrier of claim 2 wherein the central line of weakness extends between adjacent finger apertures.

4. Carrier stock for unitizing a plurality of containers comprising:

a generally continuous plastic sheet having a first longitudinal edge and a second longitudinal edge and a plurality of container apertures extending longitudinally in adjacent pairs and arranged in repeating groups of six container apertures;

exclusively at each of alternating adjacent pairs of container apertures, a central line of weakness extending in the plastic sheet between the container apertures in an adjacent pair;

a first peripheral line of weakness near the first longitudinal edge and between one container aperture of a pair of container apertures and a container aperture immediately to one side; and a second peripheral line of weakness near the second longitadinal edge and between an other container aperture of the pair of container apertures and a container aperture immediately to an other side, opposite the one side, such that when the central line of weakness, the first peripheral line of weakness and the second peripheral line of weakness are severed, the resulting carrier includes three container apertures.

5. The cater stock of claim 4 further comprising:

a handle positioned between adjacent pairs of container apertures, the handle positioned in a different alignment from each adjacent handle.

6. The carrier stock of claim 5 wherein the handle comprises:

a finger aperture positioned between adjacent pairs of container apertures; and a strap extending through the finger aperture, the strap aligned toward one end of the finger aperture.

7. The carrier stock of claim 6 wherein the first peripheral line of weakness extends between the finger aperture and the first longitudinal edge of the plastic sheet.

8. The carrier stock of claim 6 wherein the first peripheral line of weakness extends between the finger aperture and an interior portion of the plastic sheet near first longitudinal edge of the plastic sheet.

9. The carrier stock of claim 5 wherein the handle comprises:

a finger aperture positioned between adjacent pain of container apertures; and a strap extending through the finger aperture, the strap extending asymmetrically relative to a longitudinal axis and a transverse axis of the finger aperture.

10. The carrier stock of claim 9 wherein the central line of weakness comprises a perforation that extends between, but not into, each adjacent finger aperture.

11. The carrier stock of claim 5 wherein the central line of weakness comprises a perforation extending between each adjacent handle.

12. A carrier for unitizing three containers into a package comprising:

a base carrier having six container apertures arranged in a first pair of container apertures, a second, center pair of container apertures and a third pair of container apertures, together fanning three connecting and adjacent pairs of container apertures;

a central line of weakness formed between container apertures exclusively in the center pair of container apertures; and two peripheral lines of weakness, a first peripheral line of weakness formed between the first pair of container apertures and the center pair of container apertures and a second peripheral line of weakness formed between the center pair of container apertures and the third pair of container apertures, the first peripheral line of weakness positioned near an opposite outer edge from the central line of weakness as the second peripheral line of weakness, the base carrier divisible along the central line of weakness and the two peripheral lines of weakness to form two carriers each for unitizing three containers, each of the two carriers free of additional severable lines of weakness.

13. The carrier stock of claim 12 further comprising a handle positioned between adjacent pairs of container apertures, the handle including:

a finger aperture positioned between adjacent pairs of container apertures; and a strap extending through the finger aperture, the strap extending asymmetrically relative to a longitudinal axis and a transverse axis of the finger aperture.

14. The carrier stock of claim 13 wherein the central line of weakness comprises a perforation that extends between, but not into, each adjacent finger aperture.

15. Carrier stock for unitizing three containers into a package comprising:

a generally continuous plastic sheet having a first longitudinal edge and a second longitudinal edge and a plurality of container apertures extending longitudinally in adjacent pairs for positioning a container in each container aperture of the plurality of container apertures;

a central line of weakness extending in the plastic sheet between the container apertures of adjacent pairs, in exclusively alternating adjacent pairs;

a first peripheral line of weakness near the first longitudinal edge and between one container aperture of a pair of container apertures and a container aperture immediately to one side;

a second peripheral line of weakness near the second longitudinal edge and between an other container aperture of the pair of container apertures and a container aperture immediately to an other side, opposite the one side, forming the package of three containers, each of the two carriers are free of additional severable lines of weakness; and a handle formed in each package.

16. The carrier stock of claim 15 wherein the handle is positioned between adjacent pairs of container apertures, the handle positioned in a different alignment from each adjacent handle.

17. The carrier stock of claim 15 wherein the handle comprises:

a finger loop positioned within each third container aperture along the first longitudinal edge and each third container aperture along the second longitudinal edge, and each first adjacent pair of container apertures and each third adjacent pair of container apertures include the finger loop along opposite longitudinal edges of the plastic sheet.

18. The carrier stock of claim 15 wherein the three containers are arranged in a generally triangular package.

* * * * *